US005135403A

United States Patent [19]

Rinaldi

[11] Patent Number: 5,135,403

[45] Date of Patent: Aug. 4, 1992

[54] SOLDERLESS SPRING SOCKET FOR PRINTED CIRCUIT BOARD

[75] Inventor: John A. Rinaldi, Waterbury, Conn.

[73] Assignee: AMP Incorporated, Harrisburg, Pa.

[21] Appl. No.: 823,080

[22] Filed: Jan. 14, 1992

Related U.S. Application Data

[63] Continuation of Ser. No. 712,309, Jun. 7, 1991, abandoned.

[51] Int. Cl.[5] ..... H01R 9/09

[52] U.S. Cl. ..... 439/82; 439/857

[58] Field of Search ..... 439/81, 82, 844, 856, 439/857

[56] References Cited

U.S. PATENT DOCUMENTS

| | | | |
|---|---|---|---|
| 4,585,295 | 4/1986 | Ackerman | 439/857 |
| 4,614,388 | 9/1986 | Powell | 339/17 C |
| 4,728,304 | 3/1988 | Fischer | 439/857 |
| 4,735,575 | 4/1988 | Shaffer | 439/82 |
| 4,752,250 | 6/1988 | Seidler | 439/82 |
| 4,781,602 | 11/1988 | Cobaugh | 439/82 |

OTHER PUBLICATIONS

"Hextite Press-Fit Sockets" pp. 2 and 3, Nov. 9, 1989, Mark Eyelet Inc.

"Zero—Profile Solderless Sockets", pp. 4 and 5, Augat Company.

*Primary Examiner*—Paula A. Bradley

[57] ABSTRACT

A solderless spring socket for use in printed circuit boards is disclosed. The socket includes a first section having outwardly biased, resilient retention members for engaging a wall of a plated through hole in the circuit board to retain the socket therein. The socket further includes a second section having inwardly biased spring fingers for compressively engaging a lead from an electronic package inserted thereinto.

26 Claims, 4 Drawing Sheets

SOLDERLESS SPRING SOCKET FOR PRINTED CIRCUIT BOARD

This application is a continuation of application Ser. No. 07/712,309 filed Jun. 7, 1991, now abandoned.

FIELD OF THE INVENTION

The present relates to spring sockets which are inserted into plated through holes in a printed circuit board for the purpose of receiving leads from electronic components mounted on the board.

BACKGROUND OF THE INVENTION

Spring sockets, also known as mini-spring sockets, are very small tubular metal members having interior springs for compressingly gripping male leads inserted therein. These types of sockets are inserted into plated through holes in a printed circuit board and retained therein by either soldering or by a frictional fit. Their use enables an electronic component to be easily plugged into and removed from the circuit board. Of the two types of sockets, the socket of the present invention is of the solderless type wherein retention is obtained frictionally; i.e., by a portion of the socket pressing outwardly against the walls of the plated through hole. Prior art sockets of this type include one produced and sold by Mark Eyelet, Inc. under the name HEXTITE pressfit sockets, M 3300 series. One end of the socket includes a hexagonal shaped exterior surface which engages the wall of the plated through hole for retention therein. Another prior art socket, sold by the Augat Company, is the HOLTITE series zero-profile solderless socket. A circular shaped end engages the hole wall to retain the socket therein. In both cases, retention is achieved by a frictional fit and in both cases, the sockets can be replaced if needed. However, the frictional fit is achieved passively and accordingly, the plated through hole size must be within tolerance for maximum benefit. Thus, it is now proposed to provide a socket having active spring members which will retain the socket in a wider range of hole sizes. It is further proposed to provide a socket wherein the section thereof which engages the plated through hole and the section which grips the lead inserted thereinto act independently of each other to avoid adversely effecting the other.

SUMMARY OF THE INVENTION

According to the present invention, a solderless spring socket is provided. The socket includes a first section having outwardly biased, resilient retention members for engaging the wall of a plated through hole to retain the socket in a printed circuit board. The socket further includes a second section having spring fingers biased inwardly to grip a lead from an electronic package inserted into the socket.

DESCRIPTION OF THE INVENTION

Figure 1:
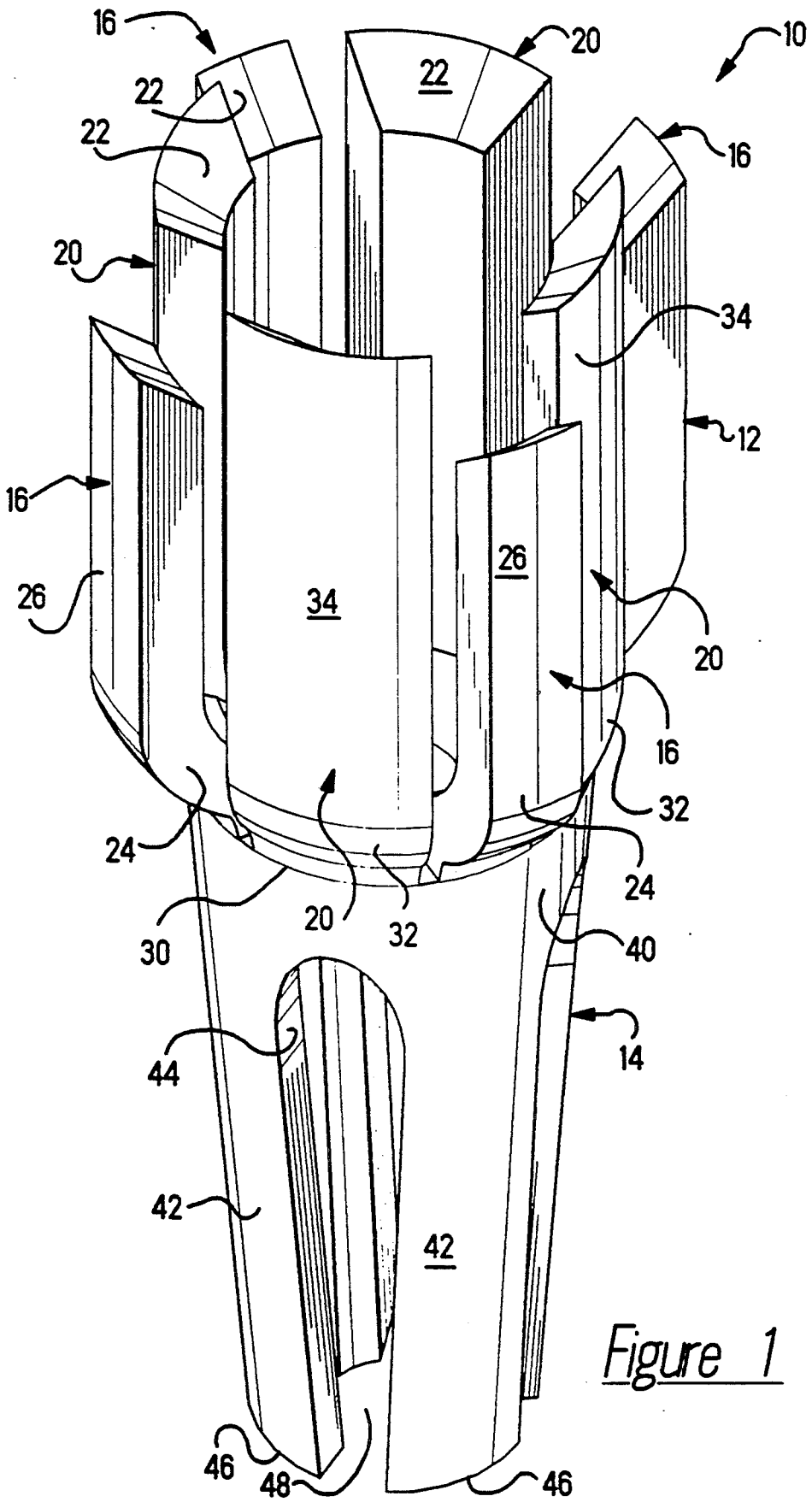
FIG. 1 is a view of one embodiment of a socket of the present invention.

With reference to FIG. 1, socket 10 shown therein is made by the deep drawn manufacturing process. The preferred material is beryllium copper alloy with gold plating on the contact surfaces.

Socket 10 includes first section 12 at one end and second section 14 at another end. Section 12 is cylindrical and includes resilient retention members 16 which are struck and bent outwardly. Intermediate members 16 are wall portions 20. The free, outwardly facing edges 22 of section 12 are beveled to provide a guiding function.

Retention members 16 include bend portions 24 and elongated portions 26. Bend portions 24, which are curved rather than sharp, are adjacent the interface, indicated by reference numeral 30, between the two sections 12,14. As shown the bend portions 24 displace the elongated portions 26 outwardly from wall portions 20 while retaining a concentric relation therewith; i.e., the two bends are ninety degrees each.

The amount of displacement is slightly greater than the largest size plated through hole first section 12 can expect to see.

Wall portions 20 also include a ninety degree bend portion 32 but which displaces elongated portions 34 outwardly very slightly.

Second section 14 includes cylindrical root portion 40 (from which first section 12 extends) and resilient contact fingers 42 extending outwardly therefrom. Fingers 42 are defined by removing material (not shown) as indicated by slots 44. Fingers 42 are preloaded by being pushed inwardly as indicated by the collective taper of the fingers 42; i.e., free ends 46 are closed towards each other to define a narrowing space 48 within the confines of second section 14.

Figure 2:
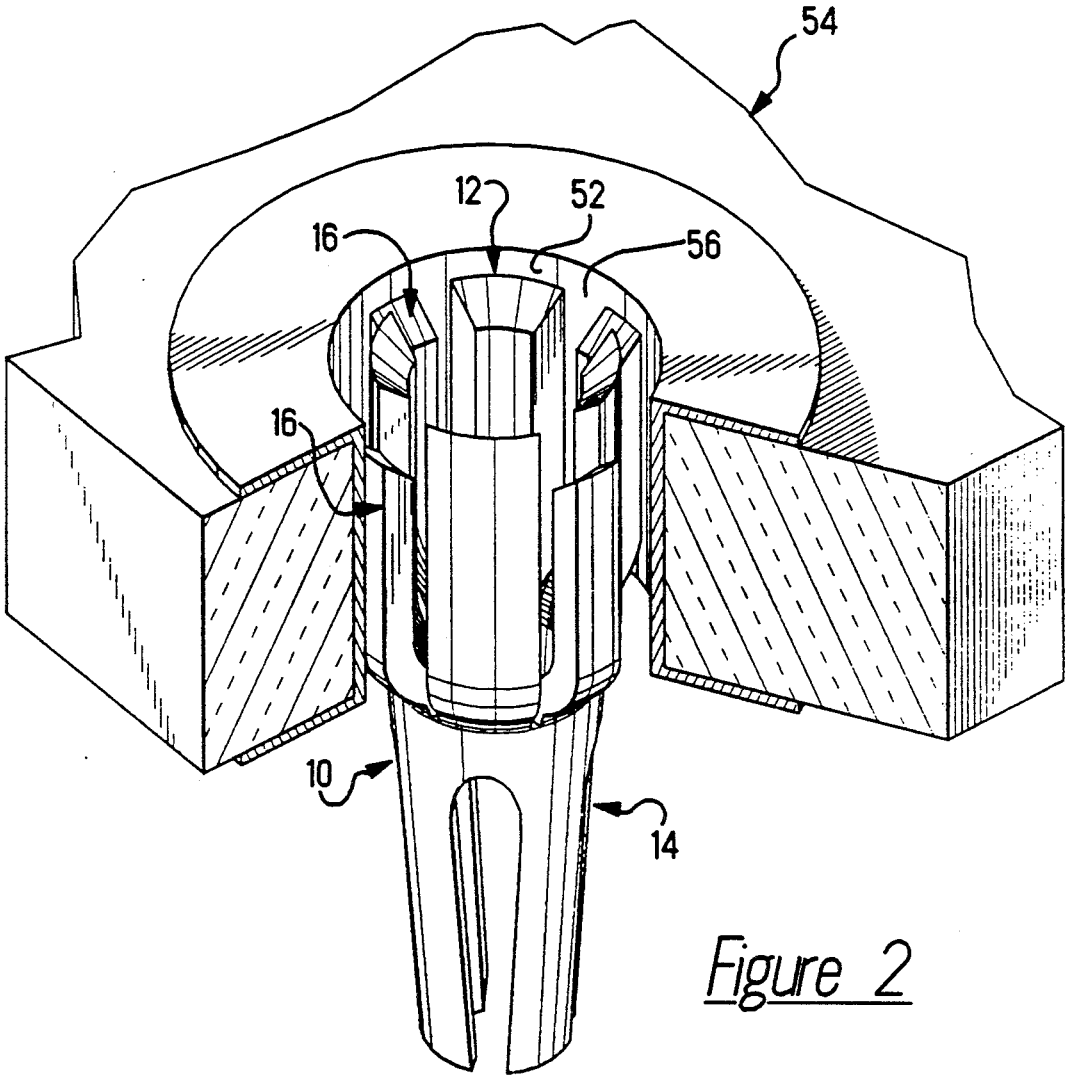
FIG. 2 is a view of the socket in a plated through holes.

FIG. 2 shows socket 10 inserted into plated through hole 52 in circuit board 54. Substantially all of first section 12 is within hole 52 with retention members 16 pressing against wall 56 of hole 52 to retain socket 10 therein. Second section 14 extends below board 54 as shown.

Figure 3:
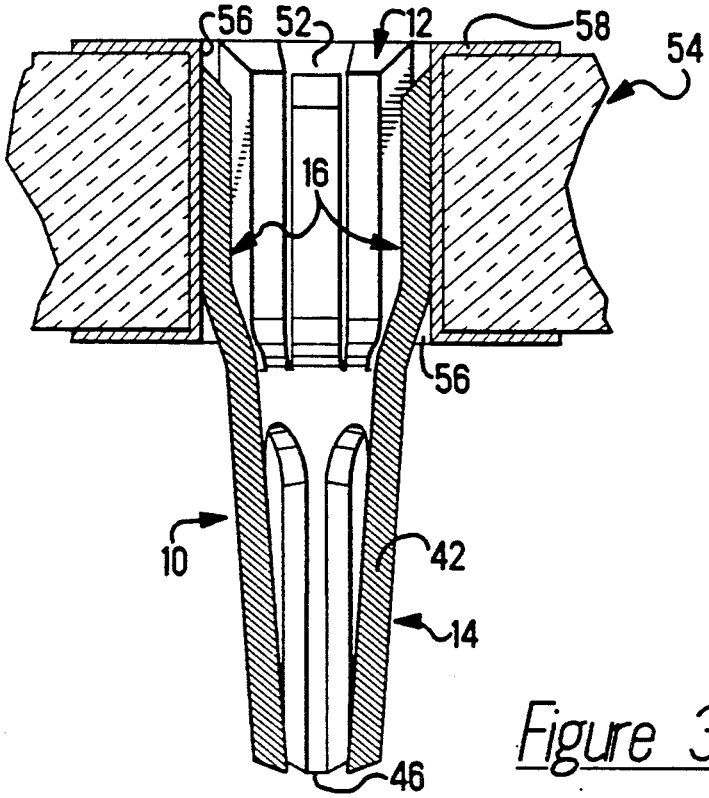
FIG. 3 is a sectioned view of the socket in a plated through hole.
Figure 4:
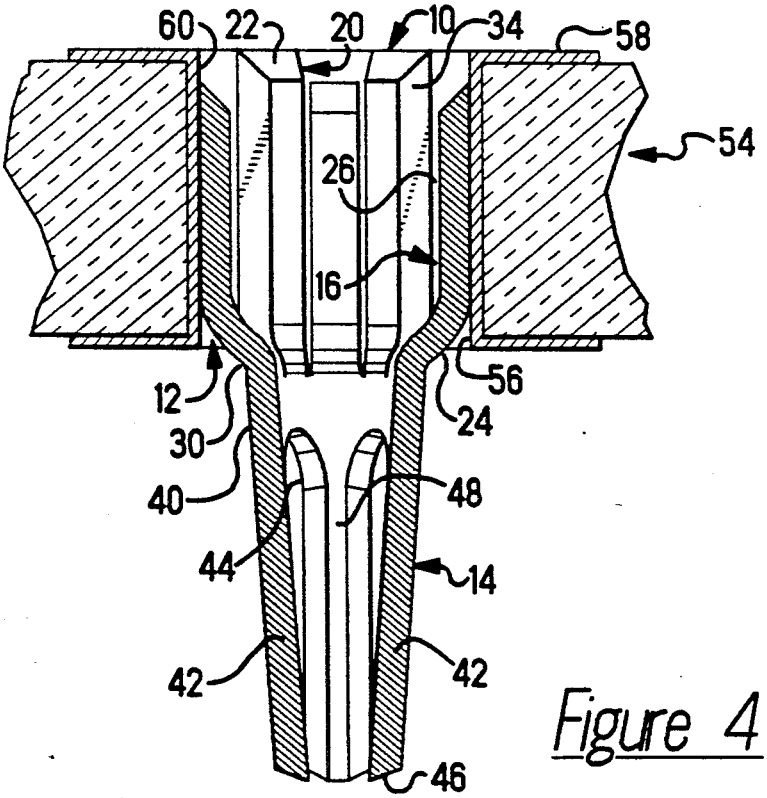
FIG. 4 is a sectioned view of the socket in a larger diameter plated through hole.

FIGS. 3 and 4 provides a more clear view of retention members 16 engaging walls 56 of holes 52 and 60 (FIG. 4). The plating of holes 52,60 and the immediate surrounding area is indicated by reference numeral 58. FIGS. 3 and 4 also provides a clearer picture of the tapering second section 14 occasioned by the preloaded fingers 42.

FIG. 4 shows socket 10 in hole 60 in circuit board 54. As a comparison with FIG. 3 will show, hole 60 is larger than hole 56 and retention members 16 are not pressed inwardly to the extent they are with respect to the smaller diameter hole 56.

Figure 5:
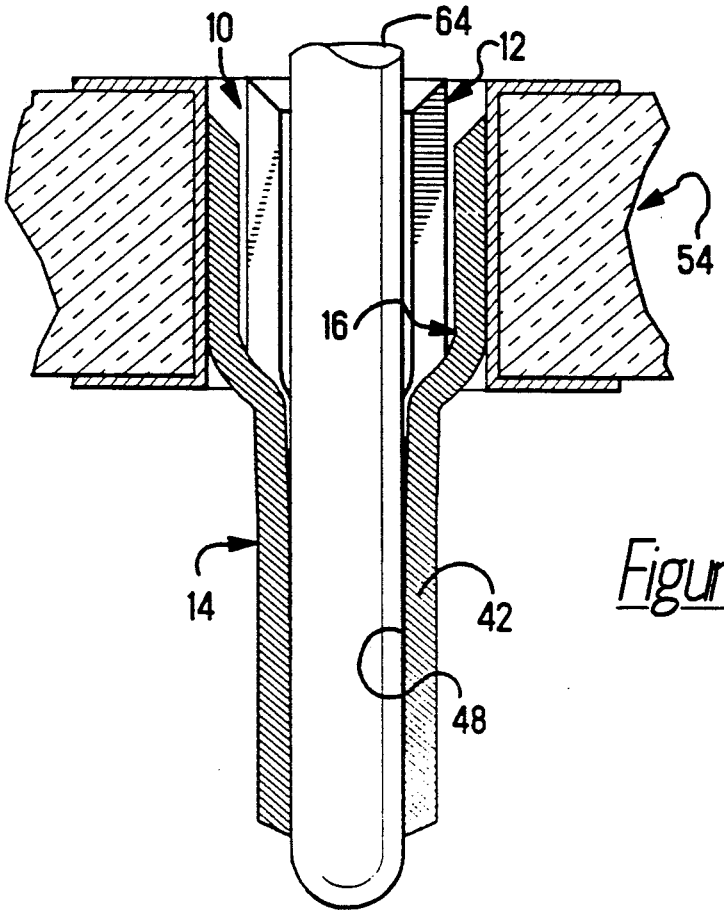
FIG. 5 is a sectioned view of a lead inserted into the socket.

FIG. 5 shows lead 64 inserted into socket 10 in circuit board 54. As lead 64 enters narrowing space 48 in section 14, fingers 42 are resiliently pushed outwardly to provide a compressive force thereagainst. Section 12 and retention members 16 thereon are unaffected by the presence of lead 64.

Figure 6:
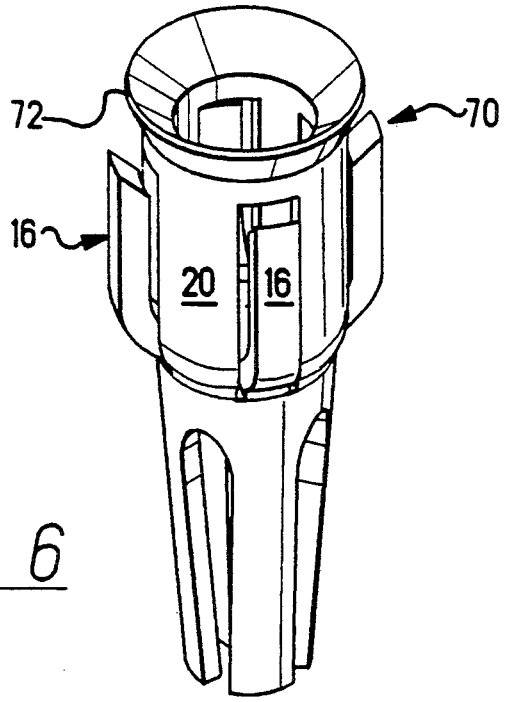
FIG. 6 is a view of another embodiment of a socket of the present invention.

FIG. 6 shows socket 70 which is another embodiment of the present invention. Socket 70 includes all of the structural features of socket 10 plus a integral funnel portion 72 to provide a more enhanced guide for a lead 64 being inserted. Wall portions 20 are joined together above retention members 16 to form the annular funnel portion 72. The outer diameter of funnel portion 72 may exceed or be less than the outer diameter defined by members 16.

As can be discerned from above, a solderless spring socket for printed circuit boards has been disclosed. The socket includes a first section which is positioned within the confines of a plated through hole in the board and which carry outwardly biased, resilient retention members. The retention members press against the wall of the hole to retain the socket in the board. A second section, connected to the first section, extends outwardly from the board and carries spring fingers which compressively grip a lead from an electronic package to make an electrical engagement therewith. Further, the socket includes a cylindrical root portion which isolates the functioning of the active components; i.e., the retention members and the spring fingers.

I claim:

1. A solderless spring socket for use in plated through holes in a printed circuit board, said socket comprising:

a first section having resilient retention members bent outwardly from a root portion, elongated portions extending from the root portion and being concentrically spaced apart, said resilient members being biased outwardly for engaging a wall of a plated through hole to retain said socket in a printed circuit board, and a second section extending from one end of said first section and having inwardly biased spring fingers for compressively gripping a lead from an electronic package which may be inserted into said socket.

2. A solderless spring socket as recited in claim 1, wherein, wall portions of said first section alternate with said retention members and are concentric therewith.

3. A solderless spring socket as recited in claim 2, and further comprising: a annular funnel portion at one end of said first section.

4. A solderless spring socket as recited in claim 2, wherein, the retention members and the spring fingers extend from opposite sides of the root portion.

5. A solderless spring socket as recited in claim 2, wherein, the root portion is cylindrical and seam free drawn.

6. A metal socket comprising: a root portion adapted for insertion in a hole of a circuit board and isolating first resilient means for engaging a wall of the hole of the circuit board from second resilient means for gripping a lead of an electronic device, the first resilient means and the second resilient means extending in opposite directions from the root portion, the first resilient means having resilient retention members being bent outwardly of the circumference of the root portion to engage a wall of the hole of the circuit board, and the second resilient means comprising converging resilient fingers.

7. A metal socket for gripping a lead of an electronic device, comprising: a root portion having a circumference for insertion in a hole of a circuit board, resilient contact fingers arranged circumferentially along the root portion and extending toward each other for gripping a lead of an electronic device inserted into the socket, and resilient retention members arranged circumferentially along the root portion, the resilient members being bent to extend outwardly beyond the circumference of the root portion to define an open end for receiving an electrical lead and to engage outwardly against a wall of a hole through a circuit board, the resilient members being separated from the contact fingers by the root portion.

8. A metal socket as recited in claim 7, wherein free ends of the retention members extend in a first direction from the root portion, and the contact fingers extend in a second direction from the root portion.

9. A metal socket as recited in claim 7, wherein the retention members extend in a first direction away from the root portion, and free edges of the contact fingers extend in a second direction away from the root portion.

10. A metal socket as recited in claim 7, wherein slots are between the contact fingers.

11. A metal socket as recited in claim 7, wherein the contact fingers and the retention members are integral with the root portion.

12. A metal socket as recited in claim 7, wherein free ends of the retention members are beveled.

13. A metal socket as recited in claim 7, and further comprising: elongated portions intermediate the retention members and being arranged along the root portion.

14. A metal socket as recited in claim 13, wherein free ends of the retention members are beveled, and free ends of the elongated portions are beveled.

15. A metal socket as recited in claim 13, wherein the elongated portions are bent to extend outwardly beyond the root portion to an extent less than the retention members extend outwardly beyond the root portion.

16. A metal socket as recited in claim 13, wherein the retention members extend outwardly beyond the root portion and outwardly beyond the elongated portions to engage outwardly against a wall of a hole through a circuit board.

17. A metal socket as recited in claim 13, wherein the elongated portions join together beyond ends of the retention members and define a funnel at one end of the socket.

18. A metal socket as recited in claim 17, wherein ends of the contact fingers are at a second end of the socket.

19. A metal socket for gripping a lead of an electronic device comprising: a root portion of a circumference adapted to be inserted in a hole through a circuit board, a first section unitary with the root portion, the first section comprising first resilient means arranged along the root portion, the first resilient means being bent therealong outwardly from the circumference of the root portion for defining an open end of the first section for receiving an electric lead and for outward resilient engagement against a wall of the hole through the circuit board, the root portion being inward circumferentially of the outwardly bent first means, and a second section unitary with the root portion, the second section comprising second resilient means arranged along the root portion, the second resilient means circumferentially converging for inward resilient gripping of a lead of an electronic device, the root portion isolating the resilient outward engagement of the first resilient means from the inward resilient gripping of the second resilient means.

20. A metal socket as recited in claim 19, wherein the second resilient means comprise resilient contact fingers.

21. A metal socket as recited in claim 19, wherein the first resilient means comprise resilient retention members.

22. A metal socket as recited in claim 19, wherein free ends of the resilient retention members are beveled.

23. A metal socket as recited in claim 19, wherein the first resilient means comprise resilient retention members, and the first section further comprises wall portions intermediate the resilient retention members, the wall portions being inward circumferentially of the resilient retention members.

24. A metal socket as recited in claim 23, wherein the wall portions and the resilient retention members are beveled at their respective free ends.

25. A metal socket as recited in claim 23, wherein the wall portions join together.

26. A metal socket as recited in claim 23, wherein the wall portions join together and provide a funnel.

* * * * *